US010234889B2

(12) United States Patent
Arnold et al.

(10) Patent No.: US 10,234,889 B2
(45) Date of Patent: Mar. 19, 2019

(54) LOW VOLTAGE CURRENT MODE BANDGAP CIRCUIT AND METHOD

(71) Applicant: TEXAS INSTRUMENTS INCORPORATED, Dallas, TX (US)

(72) Inventors: Matthias Arnold, Zolling (DE); Asif Qaiyum, Freising (DE)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/950,960

(22) Filed: Nov. 24, 2015

(65) Prior Publication Data

US 2017/0147028 A1 May 25, 2017

(51) Int. Cl.

| | |
|---|---|
| ***G05F 1/10*** | (2006.01) |
| ***G05F 3/26*** | (2006.01) |
| ***G05F 3/30*** | (2006.01) |
| *G05F 1/46* | (2006.01) |

(52) U.S. Cl.

CPC ..... *G05F 3/267* (2013.01); *G05F 3/30* (2013.01); *G05F 1/10* (2013.01); *G05F 1/46* (2013.01)

(58) Field of Classification Search

CPC . G05F 1/10; G05F 1/462; G05F 3/267; G05F 3/265; G05F 3/245; G05F 3/242; G05F 3/225; G05F 3/30; G05F 3/26; G05F 3/24; G05F 3/08; G05F 3/16

See application file for complete search history.

(56) References Cited

U.S. PATENT DOCUMENTS

| | | | | |
|---|---|---|---|---|
| 5,666,046 | A * | 9/1997 | Mietus | G05F 3/267 323/313 |
| 7,199,646 | B1 * | 4/2007 | Zupcau | G05F 3/30 323/314 |
| 2007/0132506 | A1 * | 6/2007 | Fujisawa | G05F 3/30 327/539 |
| 2008/0224682 | A1 * | 9/2008 | Haiplik | G05F 3/30 323/313 |
| 2009/0146730 | A1 * | 6/2009 | Chen | G05F 3/30 327/539 |
| 2009/0189591 | A1 * | 7/2009 | Sperling | G05F 3/30 323/315 |
| 2009/0237150 | A1 * | 9/2009 | Tsai | G05F 3/30 327/539 |

(Continued)

FOREIGN PATENT DOCUMENTS

CN 204440214 U 7/2015

OTHER PUBLICATIONS

Search Report for PCT No. PCT/US16/63663, dated Mar. 30, 2017 (1 page).

(Continued)

*Primary Examiner* — Gustavo Rosario Benitez
(74) *Attorney, Agent, or Firm* — Ebby Abraham; Charles A. Brill; Frank D. Cimino

(57) ABSTRACT

A proportional to absolute temperature (PTAT) generator, for example, generates a PTAT current (IPTAT) and a VBE (voltage base-to-emitter) in a first regulation loop. A voltage-to-current converter is operable to generate a complementary to absolute temperature current (ICTAT). The IPTAT and ICTAT are summed to obtain a zero temperature coefficient current (IZTC). One ICTAT and one resistor are used to generate the IZTC signal.

4 Claims, 8 Drawing Sheets

(56) References Cited

U.S. PATENT DOCUMENTS

| | | | | |
|---|---|---|---|---|
| 2009/0256623 | A1* | 10/2009 | Tajima | G05F 3/30 327/512 |
| 2010/0052643 | A1 | 3/2010 | Cho et al. | |
| 2011/0043185 | A1 | 2/2011 | Kim | |
| 2011/0169561 | A1* | 7/2011 | Chu | G05F 3/30 327/539 |
| 2012/0068685 | A1* | 3/2012 | Chang | G05F 3/30 323/313 |
| 2013/0234781 | A1* | 9/2013 | Bernardinis | G05F 3/30 327/513 |
| 2013/0265083 | A1* | 10/2013 | Lin | H02M 11/00 327/103 |
| 2015/0346746 | A1* | 12/2015 | Huang | G05F 1/56 323/313 |

OTHER PUBLICATIONS

CN204440214, English Machine Translation, dated Jun. 8, 2017 (10 pages).

* cited by examiner

LOW VOLTAGE CURRENT MODE BANDGAP CIRCUIT AND METHOD

BACKGROUND

Many applications of integrated circuits require the integrated circuits to work from low supply voltages and to consume relatively low amounts of power. Many, if not most, of these integrated circuits incorporate a bandgap reference circuit to provide a constant voltage reference. Such bandgap reference circuits are typically required to have capability to generate accurate reference voltages even at low supply voltages. However, providing accurate reference voltages even at low supply voltages often requires using large resistors than occupy large areas of the band reference circuits, which increases costs.

SUMMARY

The problems noted above can be addressed in a proportional to absolute temperature (PTAT) generator that generates PTAT current (IPTAT) and a VBE (voltage base-to-emitter) in a first regulation loop. A voltage-to-current converter is operable to generate a complementary to absolute temperature current (ICTAT). The IPTAT and ICTAT are summed to obtain a zero temperature coefficient current (IZTC). For example, only one ICTAT and one (e.g., sole) resistor need be used to generate the IZTC signal (e.g., in contrast with conventional solutions that require two such resistors occupying twice the area of disclosed solutions). It can be seen that the sole resistor used can be "split" into smaller resistors (e.g., coupled in parallel) to provide a total resistance equal to the sole resistor; however, the total area occupied by such split resistors is typically the same as the area of the sole transistor, and the current carried by each of the split transistors is in accordance with the proportion of the resistance of each split resistor to the resistance of the sole resistor. As used herein, the term "sole resistor," for example, encompasses the meaning of a real and/or a notional resistor comprising the total of the resistance(s) of each of the split resistors (e.g., such that the sole transistor has a resistance equal to the sum of the resistances of the split resistors).

In an embodiment, the ICTAT generator includes an amplifier and a resistor operable to generate the ICTAT as a function of the VBE and the value of the resistor. In another embodiment, the ICTAT generator includes a resistor operable to generate the ICTAT as a function of the VBE, the VPTAT, and the value of the resistor.

This Summary is submitted with the understanding that it is not be used to interpret or limit the scope or meaning of the claims. Further, the Summary is not intended to identify key features or essential features of the claimed subject matter, nor is it intended to be used as an aid in determining the scope of the claimed subject matter.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be example of that embodiment, and not intended to intimate that the scope of the disclosure, including the claims, is limited to that embodiment.

Certain terms are used throughout the following description—and claims—to refer to particular system components. As one skilled in the art will appreciate, various names may be used to refer to a component or system. Accordingly, distinctions are not necessarily made herein between components that differ in name but not function. Further, a system can be a sub-system of yet another system. In the following discussion and in the claims, the terms "including" and "comprising" are used in an open-ended fashion, and accordingly are to be interpreted to mean "including, but not limited to . . . ." Also, the terms "coupled to" or "couples with" (and the like) are intended to describe either an indirect or direct electrical connection. Thus, if a first device couples to a second device, that connection can be made through a direct electrical connection, or through an indirect electrical connection via other devices and connections. The term "portion" can mean an entire portion or a portion that is less than the entire portion. The term "input" can mean either a source or a drain (or even a control input such as a gate where context indicates) of a PMOS (positive-type metal oxide semiconductor) or NMOS (negative-type metal oxide semiconductor) transistor. The term "mode" can mean a particular architecture, configuration (including electronically configured configurations), arrangement, application, and the like, for accomplishing a purpose. The term "processor" can mean a circuit for processing, a state machine and the like for execution of programmed instructions for transforming the processor into a special-purpose machine, circuit resources used for the processing, and combinations thereof.

Figure 1:
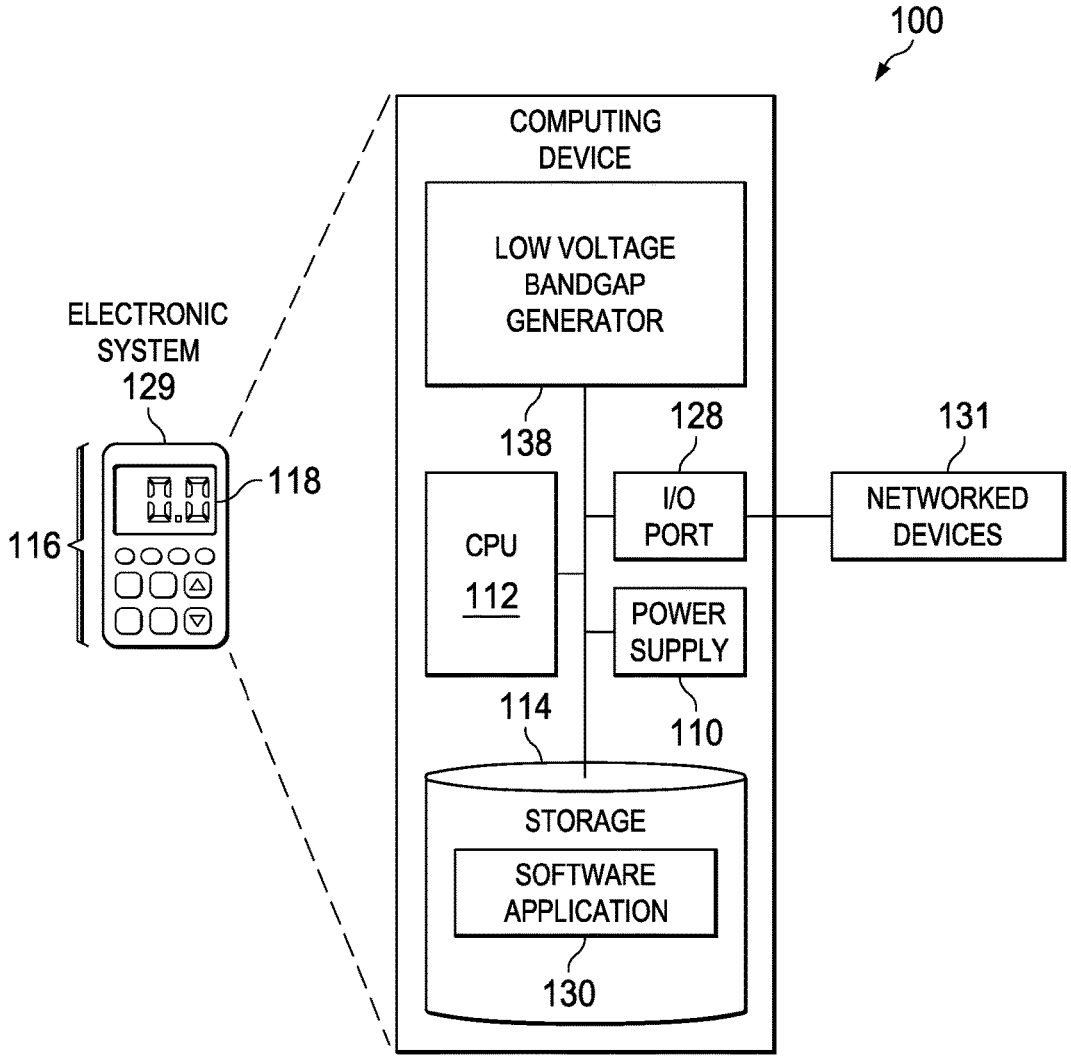
FIG. 1 shows an illustrative electronic device in accordance with example embodiments of the disclosure.

FIG. 1 shows an illustrative computing system 100 in accordance with certain embodiments of the disclosure. For example, the computing system 100 is, or is incorporated into, an electronic system 129, such as a computer, electronics control "box" or display, communications equipment (including transmitters), or any other type of electronic system arranged to generate electrical signals.

In some embodiments, the computing system 100 comprises a megacell or a system-on-chip (SoC) which includes control logic such as a CPU 112 (Central Processing Unit), a storage 114 (e.g., random access memory (RAM)) and a power supply 110. The CPU 112 can be, for example, a CISC-type (Complex Instruction Set Computer) CPU, RISC-type CPU (Reduced Instruction Set Computer), MCU-type (Microcontroller Unit), or a digital signal processor (DSP). The storage 114 (which can be memory such as on-processor cache, off-processor cache, RAM, flash memory, or disk storage) stores instructions for one or more software applications 130 (e.g., embedded applications) that, when executed by the CPU 112, perform any suitable function associated with the computing system 100.

The CPU 112 comprises memory and logic circuits that store information frequently accessed from the storage 114. The computing system 100 is often controlled by a user using a UI (user interface) 116, which provides output to and receives input from the user during the execution the software application 130. The output is provided using the display 118, indicator lights, a speaker, vibrations, and the like. The input is received using audio and/or video inputs (using, for example, voice or image recognition), and electrical and/or mechanical devices such as keypads, switches, proximity detectors, gyros, accelerometers, and the like. The CPU 112 is coupled to I/O (Input-Output) port 128, which provides an interface operable to receive input from (and/or provide output to) networked devices 131. The networked devices 131 can include any device capable of point-to-point and/or networked communications with the computing system 100. The computing system 100 can also be coupled to peripherals and/or computing devices, including tangible, non-transitory media (such as flash memory) and/or cabled or wireless media. These and other input and output devices are selectively coupled to the computing system 100 by external devices using wireless or cabled connections. The storage 114 can be accessed by, for example, by the networked devices 131.

The CPU 112 is coupled to I/O (Input-Output) port 128, which provides an interface operable to receive input from (and/or provide output to) peripherals and/or computing devices 131, including tangible (e.g., "non-transitory") media (such as flash memory) and/or cabled or wireless media (such as a Joint Test Action Group (JTAG) interface). These and other input and output devices are selectively coupled to the computing system 100 by external devices using or cabled connections. The CPU 112, storage 114, and power supply 110 can be coupled to an external power supply (not shown) or coupled to a local power source (such as a battery, solar cell, alternator, inductive field, fuel cell, capacitor, and the like).

The computing system 100 includes a low voltage current mode bandgap generator 138 for generating bandgap (e.g., temperature-independent) current and/or voltage references. The disclosed bandgap reference architecture is capable of working over a wide supply voltage range that is, for example, as low (e.g., around 100-200 mV) as a selected VZTC plus the VDS (voltage drain-to-source) of a selected transistor. For example, when the VZTC>VBE+V(R502), the transistor P502 is selected, otherwise P501 is selected.

The disclosed supply voltage bandgap voltage reference generator 138 typically requires half the resistance (e.g., by eliminating a large-area resistor commonly used in conventional bandgap voltage reference generators) while achieving temperature-independent reference voltages while providing a with the new bandgap core structure (e.g., arrangement of bipolar transistors and resistors) that quickly and reliably achieves a stable operating point. An operating point is a point (e.g., for a given set of selected values of components of a circuit) in which a stable operating voltage is achieved by the circuit. A valid (e.g., correct) operating point is a point at which the circuit operates in accordance with its intended function. (Accordingly, an operating point can be valid or invalid depending on context.)

Figure 2:
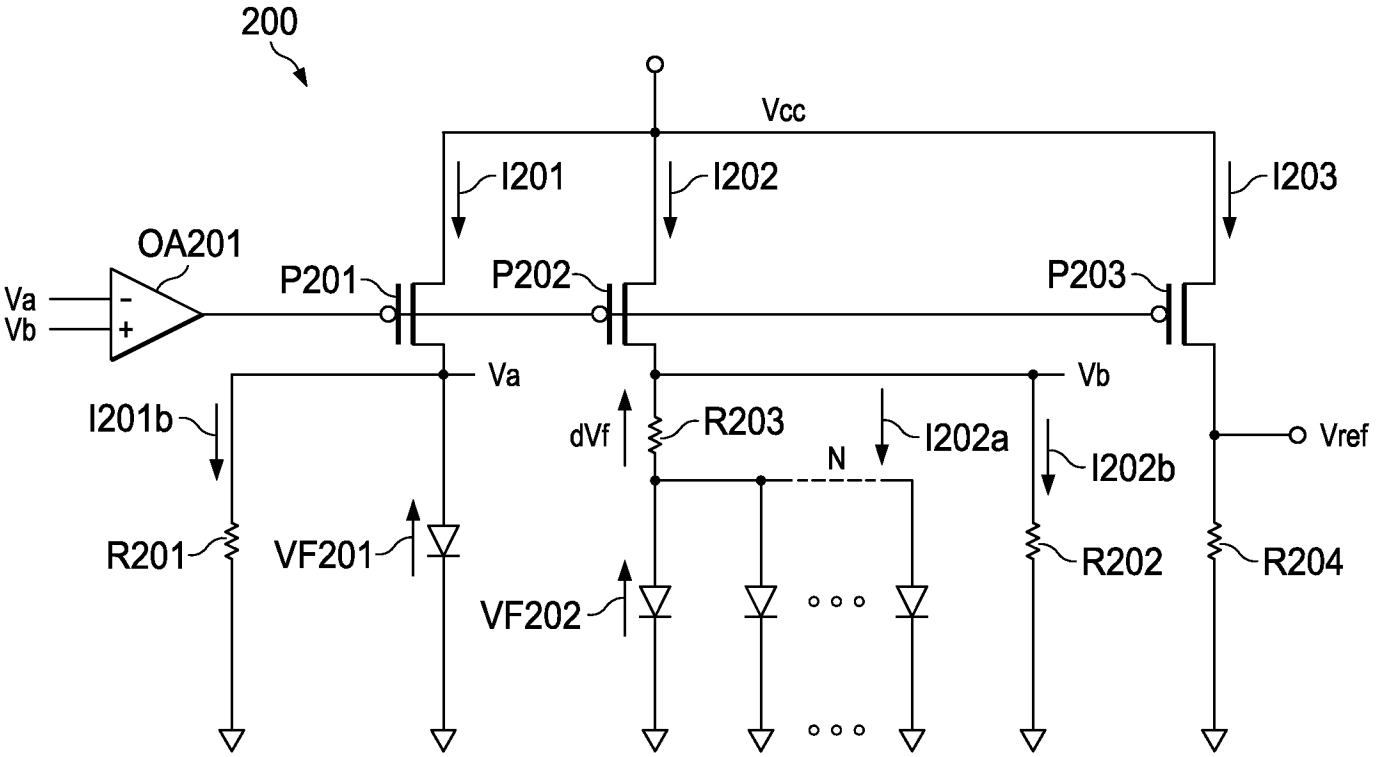
FIG. 2 (PRIOR ART)
FIG. 2 is a schematic of a prior art bandgap circuit 200 having a Banba architecture.

FIG. 2 is a schematic of a bandgap circuit 200 having a "Banba" architecture. The bandgap circuit 200 includes PMOS transistors P201, P202, and P203, and resistors R201, R202, R203, and R204. In operation, a current controlled by PMOS transistor P201 generates the current I201, which in turn generates voltage Va in accordance with the current-density-dependent voltage drop VF201 and the current I201*b* (flowing through resistor R201). In a similar manner, PMOS transistor P202 generates the current I202, which in turn generates voltage Vb in accordance with the current-density-dependent voltage drop VF202 (which is related to the current I202*a*) and the current I202*b* (flowing through resistor R202). The current densities cause VF201 and VF202 to differ in accordance in with the number of N diodes sourced by PMOS transistor P202. The voltages Va and Vb drive a differential amplifier, which generates a temperature-independent control signal for driving the PMOS transistors P202, P202, and P203. A temperature-independent voltage Vref is output in accordance with the current I203 (generated by PMOS transistor P203) and resistor 8204.

The Banba bandgap architecture operates in a current (e.g., flow) domain (as compared to the voltage domain in which bandgap circuit 300 operates). The Banba bandgap architecture generates a constant voltage by adding the delta VBE dependent current (IPTAT) to a correct proportion of the VBE dependent current (ICTAT) and passing it through a similar type resistor by which VBE and ΔVBE current has been generated. The minimum voltage supply (Vdd) required to operate the Banba bandgap architecture is VBE+Vdsat. For example, when the bipolar transistor has a VBE of 0.8V and the PMOS control transistor has a Vdsat of 0.1V, the minimum operating Vdd is approximately 0.9V.

However, the Banba bandgap architecture operates with higher inaccuracies that result from the current mirroring used to generate the reference voltage. Further, such inaccuracies progressively become even greater as the Vdsat is decreased and as increasingly deeper sub-micron processes are used. The Banba bandgap architecture also has multiple operating points and might not reach a correct operating point without additional control circuitry and a very low operational amplifier offset. The offset of the operational amplifier is reduced to a relatively very low amount by using relatively large transistor areas within the operational amplifier OA201 as well as P201 and P202 (e.g., which increases costs).

Figure 3:
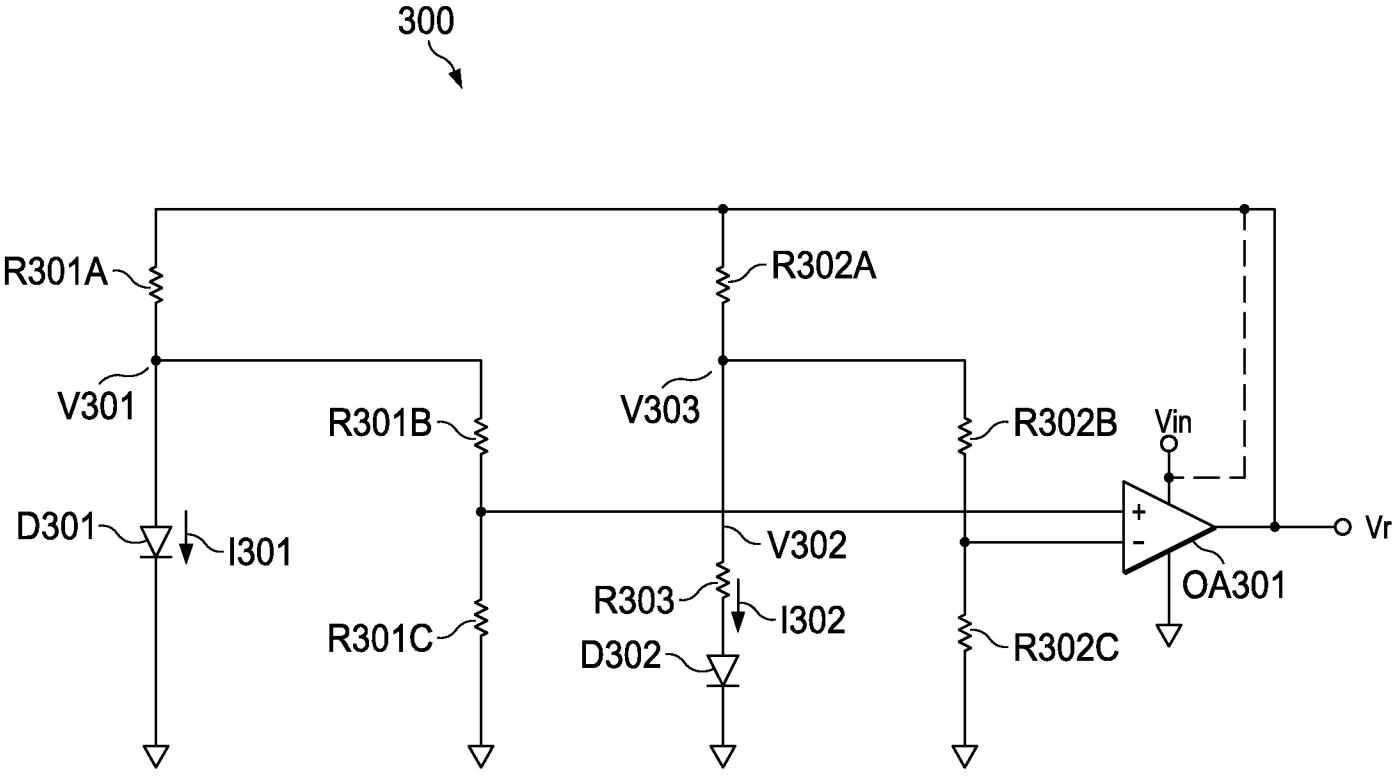
FIG. 3 (PRIOR ART)
FIG. 3 is a schematic of a prior art bandgap circuit 300 having a Hazucha architecture.

FIG. 3 is a schematic of a bandgap circuit 300 having a "Hazucha" architecture. The bandgap circuit 300 includes diodes D301, D302, resistors R301A, R301B, R301C, R302A, R302B, R202C, and R303. In operation, voltage V301 is generated in accordance with the current I301 (e.g., sourced from resistor R301A) and the current-density-dependent voltage drop across diode D301. The voltage V301 is divided by resistors R301B and R301C to generate voltage 302, which is coupled to a non-inverting input of operational amplifier 301. The voltage V303 is generated in accordance with the current I302 (e.g., sourced from resistor R302A) and the current-density-dependent voltage drop across diode D302. The voltage V303 is divided by resistors R302B and R302C to generate a voltage coupled to an inverting input of the operational amplifier OA301. The current densities cause of diode D301 and D302 to differ in accordance in with the ratio of respective aspect ratios of the active area of the diodes D301 and D302. The operational amplifier generates a temperature-independent voltage Vr. The bandgap circuit 300 does not provide a PTAT; instead, the bandgap circuit 300 generates a ZTC reference.

The Hazucha bandgap architecture operates in a voltage domain. The Hazucha bandgap architecture generates a constant voltage by generating Vr such that a fraction of VBE is equal to a fraction of the sum of VBE and VPTAT.

However, the Hazucha bandgap architecture typically requires a relatively large resistor area when operating in low power applications. Likewise, such inaccuracies progressively become even greater as the Vdsat is decreased and as increasingly deeper sub-micron processes are used. The Hazucha bandgap architecture does not output a current that is proportional to absolute temperature (IPTAT) and entails increased costs by using relatively large resistors R301A, R301B, R301C, R302A, R302B, R202C.

Figure 4:
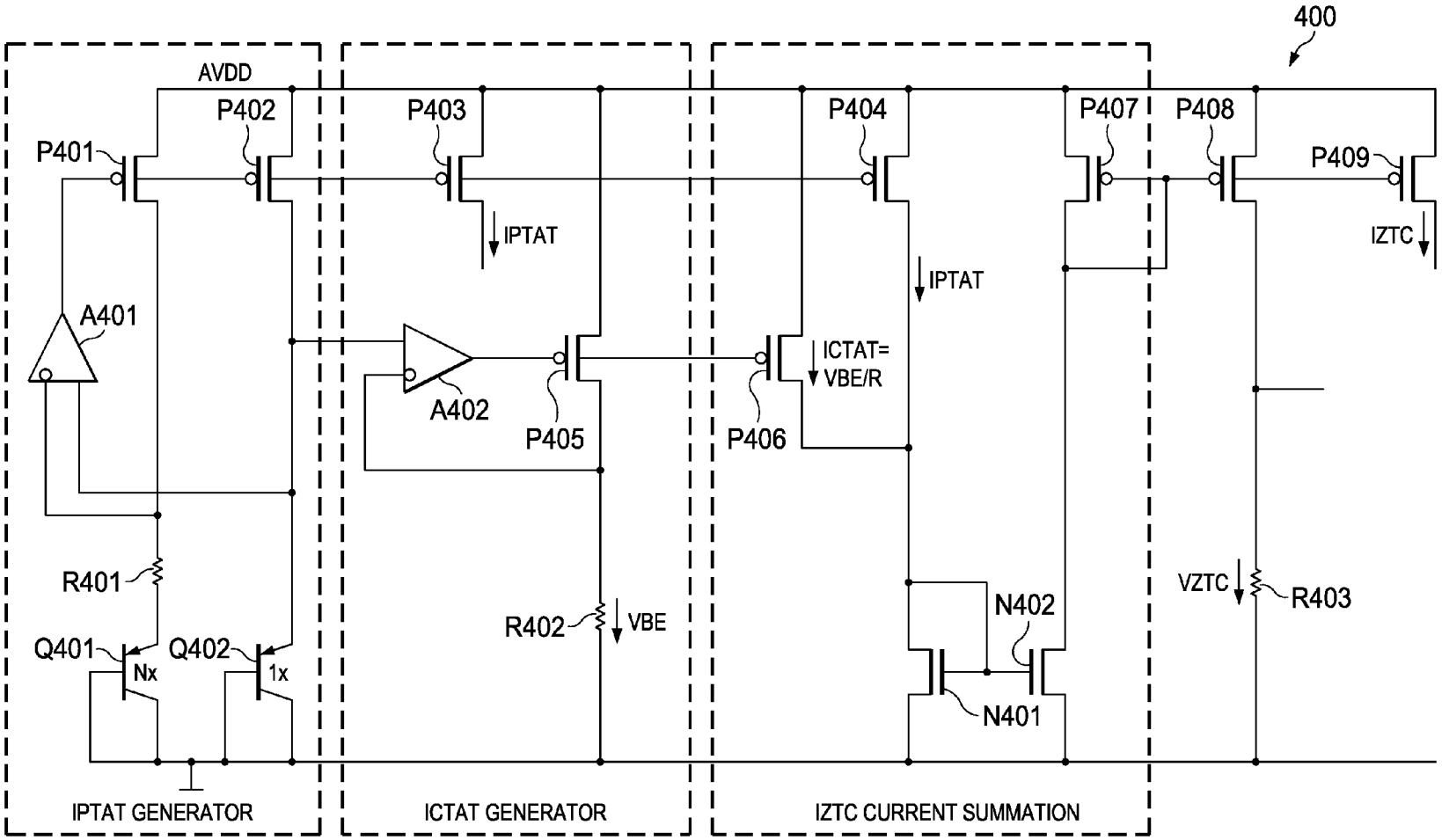
FIG. 4 (PRIOR ART)
FIG. 4 is a schematic of a prior art bandgap circuit 400 having a current summation architecture.

FIG. 4 is a schematic of a prior art bandgap circuit 400 having a current summation architecture. The bandgap circuit 400 includes an IPTAT (current proportional to absolute temperature) generator, an ICTAT (current complementary to absolute temperature) generator, and an IZTC (current with zero temperature coefficient) current summation circuit. The IPTAT generator includes a feedback control loop, which includes bipolar transistors Q401 and Q402 (having different current densities in accordance with ratio N), resistor R401, operational amplifier A401, and PMOS transistors P401 and P402. The ICTAT generator includes a feedback control loop, which includes resistor R402 and R403, operational amplifier A402, and PMOS transistors P403 and P405, where transistor P403 generates the IPTAT current under control of the output of the IPTAT generator operational amplifier A401. The IZTC current generator includes PMOS transistor P406 (for generating an ICTAT in response to the output of the operational amplifier A402 of the ICTAT generator), transistor P404 (for generating an ICTAT in response to the output of the IPTAT generator operational amplifier A401), NMOS transistors N401 and N402 (for mirroring the sum of the ICTAT and IPTAT, which summation is an IZTC) and PMOS transistor P407 and P408 for mirroring the IZTC. Resistor R403 converts IZTC to a zero temperature coefficient voltage (VZTC) whereas PMOS transistor P409 outputs IZTC under control of the current mirror formed by the PMOS transistors PMOS 407 and 408.

However, the current summation (e.g., via transistor N401) circuit 400 is unregulated (e.g., by adding two completely independent currents), which results in a low power supply rejection ratio and susceptibility to improper and/or imprecise operation due to (e.g., manufacturing) process variations.

Figure 5:
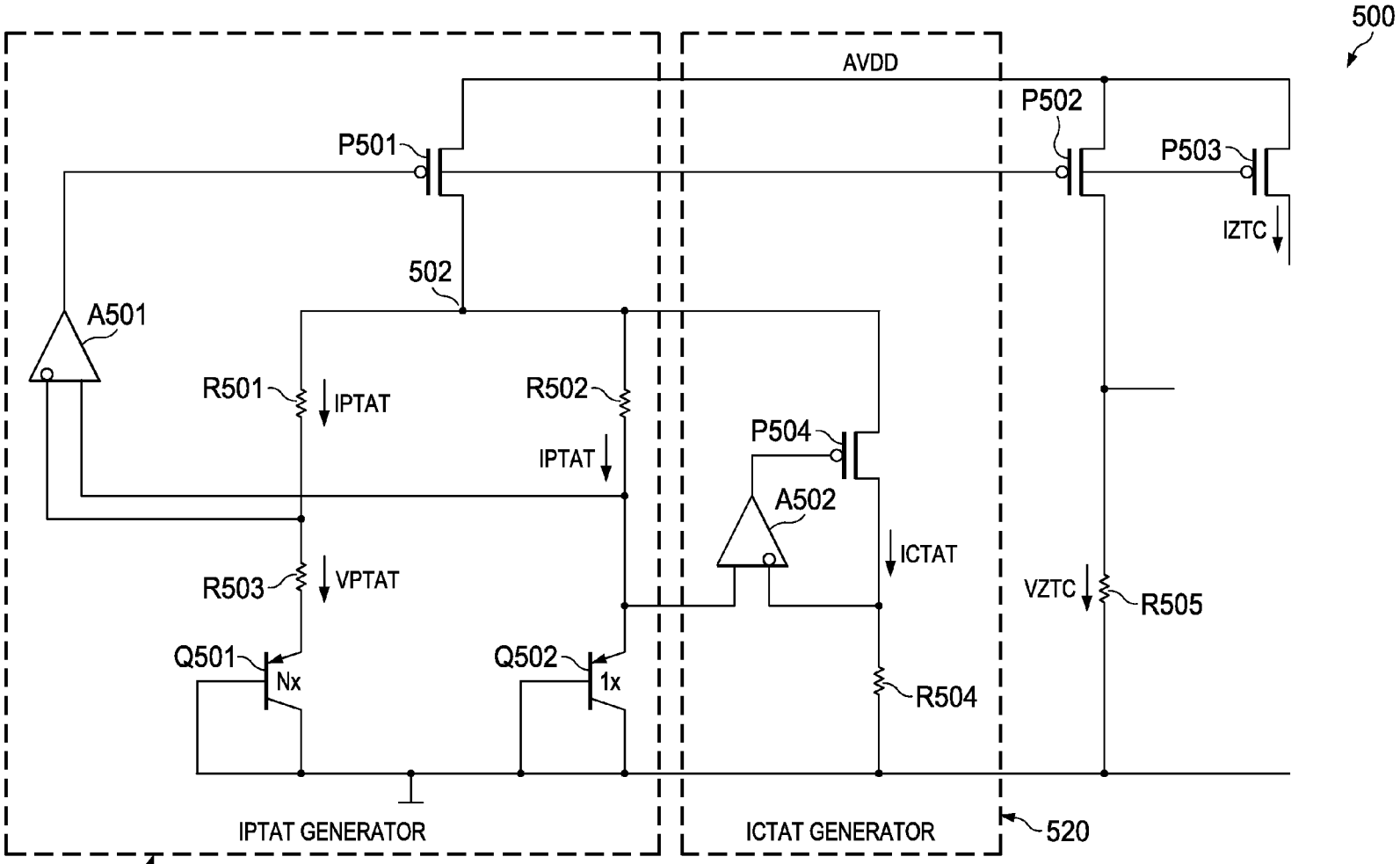
FIG. 5 is a schematic of a low voltage current mode bandgap circuit 500 having a second feedback loop-controlled ICTAT generator in accordance with embodiments of the disclosure.

FIG. 5 is a schematic of a low voltage current mode bandgap circuit 500 having a second feedback loop-controlled ICTAT generator in accordance with embodiments of the disclosure. The bandgap circuit 500 includes an IPTAT (current proportional to absolute temperature) generator 510 and an ICTAT (current complementary to absolute temperature) generator 520.

The IPTAT generator 510 includes feedback circuitry including a first feedback control loop, which includes bipolar transistors Q501 and Q502, resistors R501, R502, and R503, operational amplifier A501, and PMOS transistor P501. Transistor P501 has a gate coupled to the output of the operational amplifier 501, a source coupled to an analog supply (AVDD), and a drain coupled to an IPTAT generator 510 common node 502. The total P501 drain current sourced to the common node 502 is an IZTC current, which is divided into (e.g., at least) three branches. The first and second branches each conduct an IPTAT current (e.g., within the IPTAT generator 510, per se), where the first and second IPTAT currents are offset by an ICTAT current of a third branch discussed below (e.g., such that the IZTC is obtained). The operational amplifier 501 and the transistor P501 are operable as a two-stage amplifier, for example, where the operational amplifier A501 is a first stage and the transistor P501 is a second stage of the two-stage amplifier.

The operational amplifier A501 is operable to regulate the current flowing through P501 such that the respective voltages at each input of the operational amplifier A501 are equal. Resolving the equations associated with the first feedback control loop demonstrates that the voltage across R503 is a PTAT. In contrast, both the VBE of Q501 and VBE Q502 are CTAT. Accordingly, the PTAT is generated in accordance with the voltage difference between VBE Q501 and VBE Q502.

In operation of the IPTAT generator 510, the emitter/collector junction of transistor Q501 conducts a first regulated current sourced from the IPTAT generator 510 common node 502 (e.g., drain of P501). The first regulated current is channeled through resistor R501 and R503 and is an IPTAT in accordance with temperature characteristics of transistor Q501. A second regulated current (e.g., sourced from the drain of the transistor P501) is coupled to resistor R502, which establishes a second current branch flowing through resistor R502, where the second current branch is IPTAT. A third regulated current (e.g., also sourced from the drain of the transistor P501) is coupled to the source of transistor P504. Accordingly, the third regulated current is channeled through resistor R504, which establishes a third branch of current sourced from the IPTAT generator 510 common node 502, where the third current branch is ICTAT.

Resistors R501 (e.g., which is separately coupled in series with R503) and R502 are operable as a current splitter. Because the current-input terminals of R501 and R502 are commonly coupled (e.g., connected) with their respective output terminals being equalized by the regulation loop, the total current (notwithstanding the current channeled through P504) sourced by P501 is distributed (e.g., divided) as individual currents in accordance with the respective resistor values of R501 and R502. Accordingly, the bipolar transistors Q501 and Q502 typically have differing current values.

In an embodiment, the proportion of current division is determined in accordance with a ratio of the respective resistance values of R501 and R502, the emitter ratio (e.g., Nx) of Q501 to Q502 (e.g., such that transistors operate having mutually different current densities in accordance with the emitter ratio), and the resistance of R503. Accordingly, a first shared IPTAT-sourced current is proportionately varied as a function of temperature of a PN junction of bipolar transistor Q501, a second shared IPTAT-sourced current is inversely varied as a function of temperature by a PN junction of bipolar transistor Q502.

For example (and assuming a stable operating point has been reached), an increase in temperature causes transistor Q501 (which has a proportionately larger emitter area than Q502) to draw a greater current, which increases the amount of current of the first shared IPTAT-sourced current. Because of the sharing of the ITPAT current, the amount of current in the second shared IPTAT-sourced current becomes correspondingly and increasingly smaller as temperature increases (e.g., because less current is available for sharing). The increase in the proportion of the first and second shared IPTAT-sourced current causes a voltage rise in a first emitter control signal (e.g., generated at a center node of a voltage divider formed by resistor R501 coupled in series with resistor R503 and varied by the emitter of transistor Q501). In a similar fashion, the increase in the proportion of the first and second shared IPTAT-sourced currents causes a voltage drop in a second emitter control signal (e.g., varied by the emitter of transistor Q502). Accordingly, the second emitter control signal typically has a temperature coefficient that is opposite (e.g., complementary) to the temperature coefficient of the first emitter control signal.

In a similar example, a decrease in temperature causes a voltage drop in the first emitter control signal and a rise in the second emitter control signal (e.g., because the first shared IPTAT-sourced current progressively conducts less current and the second shared IPTAT-sourced current progressively conducts more current).

The relative resistance values of R501, R502, and R503 are selectively chosen such that a stable operating point is reached over a range of (e.g., increasing and decreasing) temperatures. For example, the resistance value of R501 is M times larger than the resistance values of R502 (e.g., such that M is the ratio of the resistances of R501 to R502), where M is determined in accordance with the emitter area (e.g., emitter current) ratio N.

The first and second emitter control signals are respectively coupled to the first (e.g., inverting) input and the second (non-inverting) input of the operational amplifier A501. The operational amplifier A501 (e.g., in response to the voltage difference between the first and second emitter control signals) generates (e.g., outputs) a first feedback (e.g., loop) control signal for driving the gates of transistors P501, P502, and P503. Accordingly, a first feedback control loop is formed which, includes the components P501, R501, R502, and A501. The first feedback control loop, for example, helps ensure the IPTAT (current) sourced by transistor P501 is well regulated, and in turn, contributes to the regulation of the first and second emitter control signals.

The second emitter control signal, which is a base-to-emitter voltage (VBE) of transistor Q502, The VBE is regulated by the first feedback control loop (e.g., the VBE is used as an input to the amplifier A501). The VBE has a temperature coefficient that is CTAT (e.g., having a complementary polarity to the temperature coefficient of the VPTAT, the VPTAT being generated across resistor R503).

The ICTAT generator 520 includes an operational amplifier A502, PMOS transistor P504, and resistor R504. The operational amplifier A502 and the PMOS transistor P504 are arranged as a (e.g., second) control loop operable as a voltage-to-current converter for converting the VBE(Q502) into a current VBE(Q502)/R504. The current VBE(Q502)/R504 exhibits the same temperature characteristics (e.g., ICTAT) of the VBE(Q502).

In operation, the second control signal (generated at the emitter of transistor Q502) is regulated by the first regulated current (sourced from transistor P501) is coupled to a first input of the operational amplifier A502, which generates a second feedback (e.g., loop) control signal for generating an ICTAT (current). Because (for example) the second control signal is generated in response to the first feedback (e.g., loop) control signal, the second control loop is dependent upon the first control loop.

The operational amplifier A502 generates a control signal in response to the voltage developed across resistor R504 in accordance with the ICTAT current flowing through transistor P504. A first control input of the operational amplifier A502 is coupled to the emitter of transistor Q502, such that the operational amplifier A502 operates in response to the voltage (VBE) of transistor Q502. A second control input of the operational amplifier A502 is coupled to the drain of transistor P504. Both the first control and the second control inputs are equalized by amplifier A502 by forcing the current through transistor P504 such that the voltage across R504 is equal to VBE(Q502) (e.g., where the forced current has temperature characteristics in accordance with the associated VBE/R).

Accordingly, the operational amplifier A502 generates a control signal (e.g., at the output of the operational amplifier A502) for driving the base of the transistor P504, which in turn controls (e.g., regulates) the ICTAT current flowing through the third current branch, which flows through resistor R504. The ICTAT is controlled in a manner that is (e.g., at least partially) separately controlled from the control signals within the first feedback loop (e.g., which includes the output of the first operational amplifier A501), which (for example, increases startup times and stability). The control signal coupled to the gate of transistor P504 can be coupled to the gates of other transistors such that the ICTAT current can be used to bias other circuits. (When additional current is drawn out of the common node 502 for the purpose of biasing further circuits for example, the proportions of currents flowing through the various branches are selected such that the total ICTAT matches the total IPTAT and such that a ZTC current is obtained.)

The ICTAT (current) flowing through resistor R504 is regulated by the second feedback loop (at least in part) independently from the IPTAT, which is regulated by the first feedback loop, which in turn is regulated second feedback loop (e.g., by the current "shunted" away from the first and second control signal nodes via transistor P504). Accordingly, the IPTAT is regulated in response to the first and second feedback loop signals, and the ICTAT is regulated in response to both the first and second feedback loop signals. Also, both the first and second feedback loops are nested (e.g., having a common portion that shares at least one signal that is being fed back), which generates high stability IZTC and VZTC reference (e.g., output) signals. Further, the second feedback control loop, for example, helps ensure the summation of VPTAT and VBE is well regulated, which provides greater power supply rejection ratios over many conventional solutions. The disclosed architecture, for example, is self-biasing and suited for low voltage operation (e.g., less than 1.2 volts).

The transistor P502 is operable to generate an IZTC (zero temperature coefficient current) in response to the first and second feedback loops (e.g., where the first feedback signal is coupled to the gate of the transistor P502). The transistor P503 is operable to generate an IZTC in response to the first feedback control signal in a manner similar to transistor P502, where the respective sources are coupled to the analog supply and the respective drains are coupled to respective circuitry for receiving an IZTC. For example, the drain of transistor P502 is coupled to a first terminal of resistor R505 at which a VZTC (zero temperature coefficient voltage) is developed as a function of the values of the resistor R505 and the IZTC.

Figure 6:
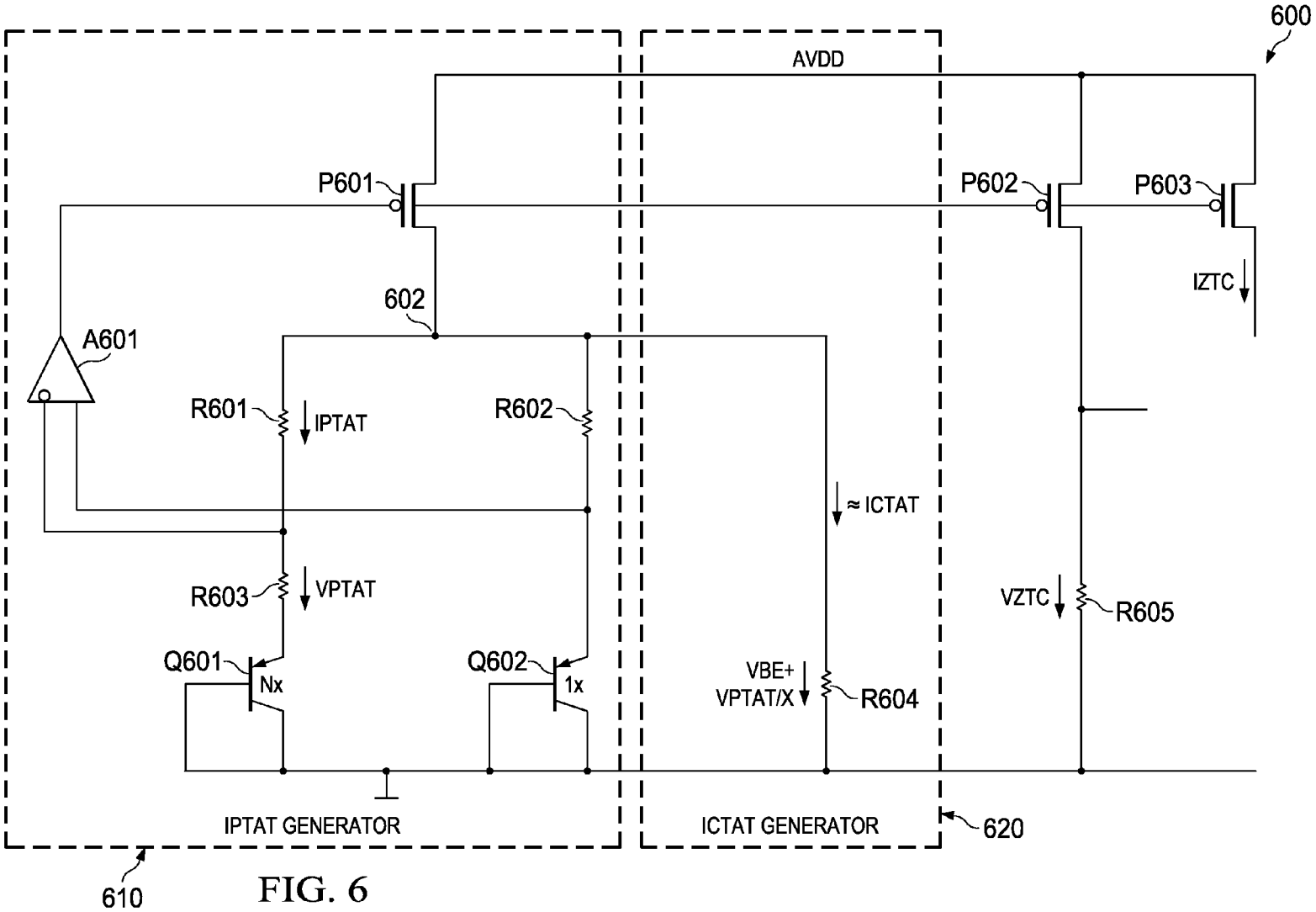
FIG. 6 is a schematic of a low voltage current mode bandgap circuit 600 having a single resistor ICTAT generator in accordance with embodiments of the disclosure.

FIG. 6 is a schematic of a low voltage current mode bandgap circuit 600 having a single resistor ICTAT generator in accordance with embodiments of the disclosure. The bandgap circuit 600 includes an IPTAT (current proportional to absolute temperature) generator 610 and an ICTAT (current complementary to absolute temperature) generator 620.

The IPTAT generator 610 includes circuitry operable as a first feedback control loop, which includes bipolar transistors Q601 and Q602, resistors R601, R602, and R603, operational amplifier A601, and PMOS transistor P601. The components of the IPTAT generator 610 (e.g., also including transistors Q601 and Q602) operate in a similar manner to the corresponding components of the IPTAT generator 510.

Accordingly, three current branches are established, each of which is sourced from the drain of transistor P601 such that the total ZTC source current from the common node 602 (e.g., the drain of transistor P601) is divided in varying amounts between and amongst the three branches. A first branch carries a first current (IPTAT), which is channeled through resistor R601. A second branch carries a second current, which is channeled through resistor R602. A third branch carries a third current, which is channeled through resistor R604. Because each of the three branches carries a portion of the total current sourced by P601, a variation in current in one branch affects the current flowing through the remaining branches.

The third current (e.g., controlled in direct proportion from the feedback control output of operational amplifier 601) is an ICTAT. The ICTAT (e.g., third current) is summed with the IPTAT (e.g., first current) to obtain a zero temperature coefficient current (e.g., the total current sourced by the drain of P601). The IPTAT is converted to VPTAT by R602 (e.g., VPTAT=IPTAT*R602). When the VPTAT is much smaller than the VBE, the sum of VBE(Q602) and VPTAT causes a current to flow through R604, where the current flowing through R604 is CTAT.

The ICTAT generator 620 includes a resistor R604. The resistor R604 is operable as a current converter for emulating the same temperature characteristics (e.g., ICTAT) of the VBE(Q602) plus the voltage developed across R602 (e.g., IPTAT*R602, which accordingly is also a VPTAT) such that the voltage across R604 is approximately equal to VBE (Q502) summed with the VPTAT developed across R602. (The VPTAT developed across R602 can be optionally divided by a resistor having a value of X to scale the developed voltage such that the ICTAT current substantially cancels temperature-induced deviations of the sum of the IPTAT currents in the first and second branches.) The third current, which carries current "shunted" away from the first and second branches, ensures the output of P601 has a zero temperature coefficient (ZTC).

The transistor P602 is operable to generate an IZTC (zero temperature coefficient current) in response to the first feedback control signal (e.g., where the first feedback signal is coupled to the gate of the transistor P602). The transistor P602 is operable to generate an IPTAT in response to the first feedback control signal in a manner similar to transistor P601, where the respective sources are coupled to the analog supply and the respective drains are coupled to respective circuitry for receiving an IZTC. For example, the drain of transistor P602 is coupled to a first terminal of resistor R605 at which a VZTC (zero temperature coefficient voltage) is developed as a function of the values of the resistor R605 and the IZTC.

Figure 7:
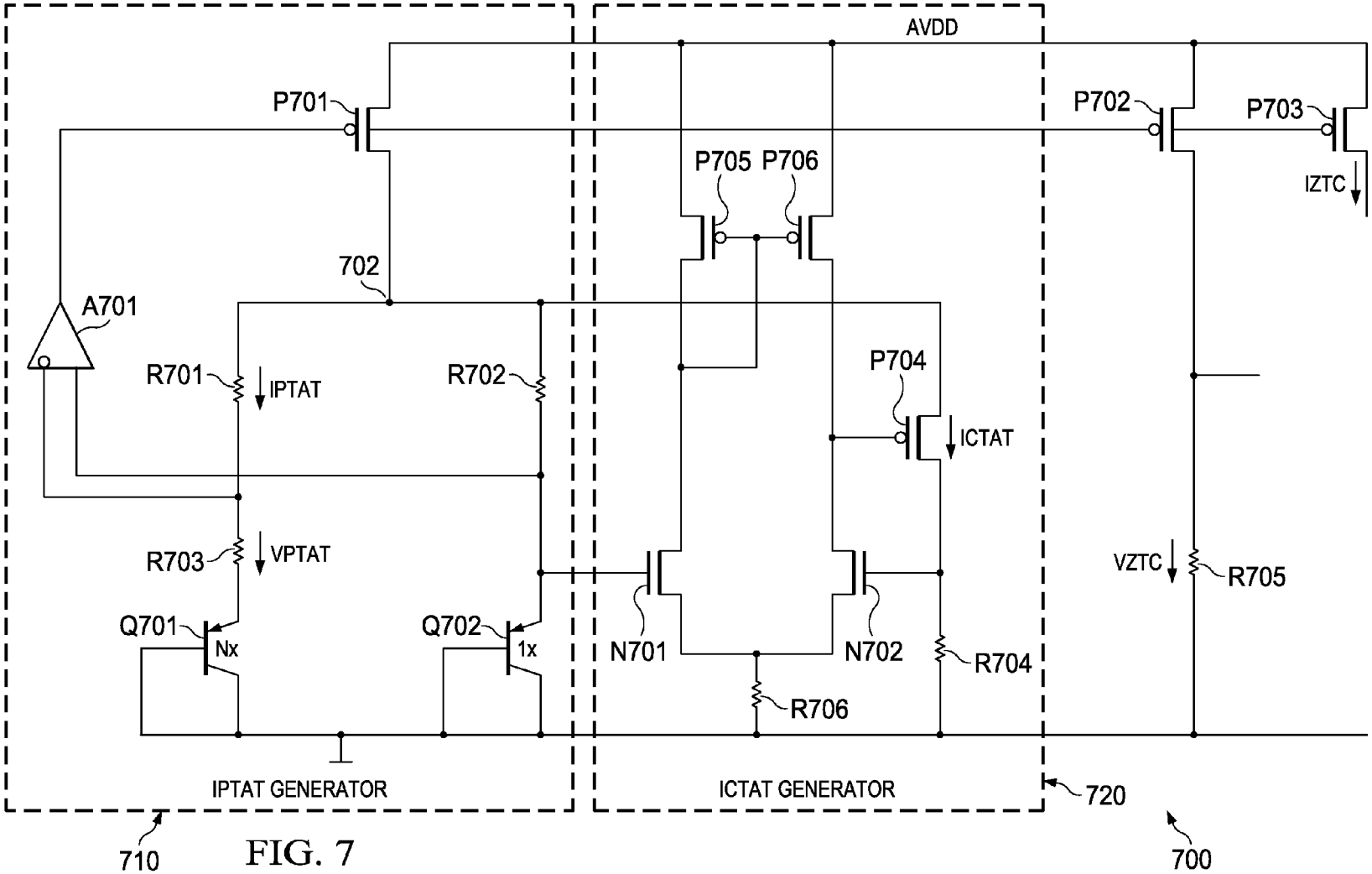
FIG. 7 is a schematic of a low voltage current mode bandgap circuit 700 having a regulated ICTAT generator in accordance with embodiments of the disclosure.

FIG. 7 is a schematic of a low voltage current mode bandgap circuit 700 having a regulated ICTAT generator in accordance with embodiments of the disclosure. The bandgap circuit 700 is the similar to the bandgap circuit 500 with at least the exception of the amplifier A502 being replaced by an example circuit in transistors such that the amplifier power supply is coupled to an analog VDD (AVDD). The bandgap circuit 700 includes an IPTAT (current proportional to absolute temperature) generator 710 and an ICTAT (current complementary to absolute temperature) generator 720.

The IPTAT generator 710 includes feedback circuitry including a first feedback control loop, which includes bipolar transistors Q701 and Q702, resistors R701, R702, and R703, operational amplifier A701, and PMOS transistor P701. Transistor P701 has a gate coupled to the output of the operational amplifier 701, a source coupled to an analog supply (AVDD), and a drain coupled to an IPTAT generator 710 common node 702 at which a (e.g., IPTAT) current is divided between two branches (e.g., within the IPTAT generator 710, per se). The operational amplifier 701 and the transistor P701 are operable as a two-stage amplifier, for example, where the operational amplifier A701 is a first stage and the transistor P701 is a second stage of the two-stage amplifier.

The operational amplifier A701 is operable to regulate the current flowing through P701 such that the respective voltages at each input of the operational amplifier A701 are equal. Resolving the equations associated with the first feedback control loop demonstrates that the voltage across R703 is a PTAT. In contrast, both the VBE of Q701 and VBE Q702 are CTAT. Accordingly, the PTAT is generated in accordance with the voltage difference between VBE Q701 and VBE Q702.

In operation of the IPTAT generator 710, the emitter/collector junction of transistor Q701 conducts a first regulated current sourced from the IPTAT generator 710 common node 702 (e.g., drain of P701). The first regulated current is channeled through resistor R701 and R703 and is an IPTAT in accordance with temperature characteristics of transistor Q701. A second regulated current (e.g., sourced from the drain of the transistor P701) is coupled to resistor R702, which establishes a second current branch flowing through resistor R702, where the second current branch is IPTAT. A third regulated current (e.g., also sourced from the drain of the transistor P701) is coupled to the source of transistor P704. Accordingly, the third regulated current is channeled through resistor R704, which establishes a third branch of current sourced from the IPTAT generator 710 common node 702, where the third current branch is ICTAT.

Resistors R701 (e.g., which is separately coupled in series with R703) and R702 are operable as a current splitter. Because the current-input terminals of R701 and R702 are commonly coupled (e.g., connected) with their respective output terminals being equalized by the regulation loop, the total current (notwithstanding the current channeled through P704) sourced by P701 is distributed (e.g., divided) as individual currents in accordance with the respective resistor values of R701 and R702. Accordingly, the bipolar transistors Q701 and Q702 typically have differing current values.

In an embodiment, the proportion of current division is determined in accordance with a ratio of the respective resistance values of R701 and R702, the emitter ratio (e.g., Nx) of Q701 to Q702 (e.g., such that transistors operate having mutually different current densities in accordance with the emitter ratio), and the resistance of R703. Accordingly, a first shared IPTAT-sourced current is proportionately varied as a function of temperature of a PN junction of bipolar transistor Q701, a second shared IPTAT-sourced current is inversely varied as a function of temperature by a PN junction of bipolar transistor Q702.

The relative resistance values of R701, R702, and R703 are selectively chosen such that a stable operating point is reached over a range of (e.g., increasing and decreasing) temperatures. For example, the resistance value of R701 is M times larger than the resistance values of R702 (e.g., such that M is the ratio of the resistances of R701 to R702), where M is determined in accordance with the emitter area (e.g., emitter current) ratio N.

The first and second emitter control signals are respectively coupled to the first (e.g., inverting) input and the second (non-inverting) input of the operational amplifier A701. The operational amplifier A701 (e.g., in response to the voltage difference between the first and second emitter control signals) generates (e.g., outputs) a first feedback (e.g., loop) control signal for driving the gates of transistors P701, P702, and P703. Accordingly, a first feedback control loop is formed which, includes the components P701, R701, R702, and A701. The first feedback control loop, for example, helps ensure the IPTAT (current) sourced by transistor P701 is well regulated, and in turn, contributes to the regulation of the first and second emitter control signals.

The second emitter control signal, which is a base-to-emitter voltage (VBE) of transistor Q702, The VBE is regulated by the first feedback control loop (e.g., the VBE is used as an input to the amplifier A701). The VBE has a temperature coefficient that is CTAT (e.g., having a complementary polarity to the temperature coefficient of the VPTAT, the VPTAT being generated across resistor R703).

The ICTAT generator 720 includes an amplifier, which includes components P705, P706, N701, N702, and R706. The amplifier of the ICTAT generator 720 is operable responsive to the VBE of Q702 and the third current sourced by the drain of P701 (e.g., the common node 702). The VBE of Q702 is coupled to a first input (the gate of N701) of the amplifier of the ICTAT generator 720, which controls a current flowing through N701. The current flowing through N701 is mirrored by P705 and P706 such that like current is provided to the drain of N702.

Transistors P705 and P706 are "high-side" transistors, which have sources coupled to a regulated analog power source (AVDD), which is also coupled to the sources of P701, P702, and P703. Coupling the high-side transistors to the AVDD allows more "headroom" and generates larger output swings than the embodiment described with respect to FIG. 8.

The third current sourced by the drain of P701 is coupled to the source of P704. The gate of transistor P704 is coupled to the drain of P706 such that P704 generates the ICTAT in response to the total current sourced by P701 and the mirrored current (e.g., mirrored VBE). Accordingly, the P704 is operable as a voltage-to-current converter for converting the VBE(Q702) into a current VBE(Q702)/R704 (e.g., the third current). The third current VBE(Q702)/R704 emulates the same temperature characteristics (e.g., ICTAT) of the VBE(Q702). The third current, which carries current "shunted" away from the first and second branches, ensures the output of the operational amplifier A701 has a zero temperature coefficient (ZTC).

The transistor P702 is operable to generate an IZTC (zero temperature coefficient current) in response to the first feedback control signal (e.g., where the first feedback signal is coupled to the gate of the transistor P702). The transistor P702 is operable to generate an IPTAT in response to the first feedback control signal in a manner similar to transistor P701, where the respective sources are coupled to the analog supply and the respective drains are coupled to respective circuitry for receiving an IZTC. For example, the drain of transistor P702 is coupled to a first terminal of resistor R705 at which a VZTC (zero temperature coefficient voltage) is developed as a function of the values of the resistor R705 and the IZTC.

Figure 8:
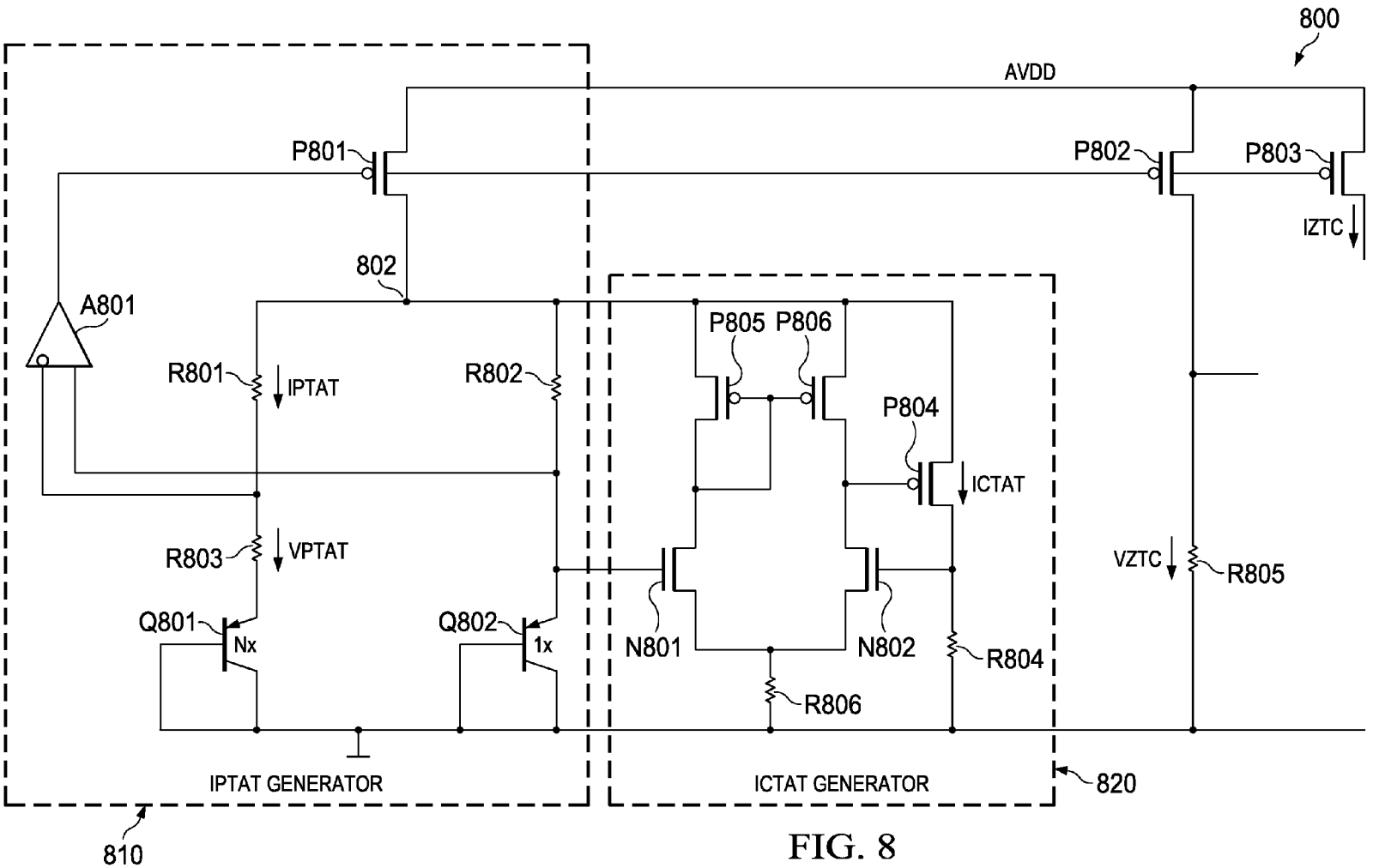
FIG. 8 is a schematic of a low voltage current mode bandgap circuit 800 having a sub-regulated ICTAT generator in accordance with embodiments of the disclosure.

FIG. 8 is a schematic of a low voltage current mode bandgap circuit 800 having a sub-regulated ICTAT generator in accordance with embodiments of the disclosure. The bandgap circuit 800 is the similar to the bandgap circuit 500 with at least the exception of the amplifier A502 being replaced by an example circuit with transistors such that the amplifier power supply is coupled to the common node 802 at the drain of P801). The bandgap circuit 800 includes an IPTAT (current proportional to absolute temperature) generator 810 and an ICTAT (current complementary to absolute temperature) generator 820.

The IPTAT generator 810 includes circuitry operable as a first feedback control loop, which includes bipolar transistors Q801 and Q802, resistors R801, R802, and R803, operational amplifier A801, and PMOS transistor P801. The components of the IPTAT generator 810 (e.g., also including transistors Q801 and Q802) operate in a similar manner to the corresponding components of the IPTAT generator 510.

Accordingly, three current branches are established, each of which is sourced from the drain of transistor P801 such that the source current from the common node 802 (e.g., the drain of transistor P801) is divided in varying amounts between and amongst the three branches. A first branch carries a first current (IPTAT), which is channeled through resistor R801. A second branch carries a second current, which is channeled through resistor R802. A third branch carries a third current, which is channeled through transistor P804 and resistor R804. Because each of the three branches carries a portion of the total current sourced by P801, a variation in current in one branch affects the current flowing through the remaining branches.

The ICTAT generator 820 includes an amplifier, which includes components P805, P806, N801, N802, and R806. The amplifier of the ICTAT generator 820 includes a first stage that includes components N801, N802, R806, P805, and P806 and a second stage that includes component N804. The amplifier of the ICTAT generator 820 is operable responsive to the VBE of Q802 and the third current sourced by the drain of P801 (e.g., the common node 802). The VBE of Q802 is coupled to a first input (the gate of N801) of the amplifier of the ICTAT generator 820, which controls a current flowing through N801.

The current flowing through N801 is mirrored by P805 and P806 such that like current is provided to the drain of N802. When the sum of the currents through P805 and P806 are considered to be the supply current of the amplifier, the amplifier current is ICTAT. The amplifier current is determined in accordance with the relationship (VBE(Q802)−VGS(N801))/R806 and has a temperature characteristic that is approximately CTAT. P805 and P806 have sources coupled to the drain of P801 (the common node 802) such that fourth and fifth current branches are formed. Accordingly, the two CTAT currents of the fourth and fifth current branches are selected to balance against the total IPTAT such that an IZTC is obtained. Additionally, the amplifier of the ICTAT generator 820 has a better power supply rejection than the amplifier of the ICTAT generator 720 (e.g., because of the coupling of the sources of P805 and P806 to the drain of P801).

The third current sourced by the drain of P801 is coupled to the source of P804. The gate of transistor P804 is coupled to the drain of P806 such that P804 generates the ICTAT in response to the total current sourced by P801 and the mirrored current (e.g., mirrored VBE). Accordingly, the P804 is operable as a voltage-to-current converter for converting the VBE(Q802) into a current VBE(Q802)/R804 (e.g., the third current). The third current VBE(Q802)/R804 emulates the same temperature characteristics (e.g., ICTAT) of the VBE(Q802). The third current, which carries current "shunted" away from the first and second branches, ensures the output of the operational amplifier A801 has a zero temperature coefficient (ZTC).

The transistor P802 is operable to generate an IZTC (zero temperature coefficient current) in response to the first feedback control signal (e.g., where the first feedback signal is coupled to the gate of the transistor P802). The transistor P802 is operable to generate an IPTAT in response to the first feedback control signal in a manner similar to transistor P801, where the respective sources are coupled to the analog supply and the respective drains are coupled to respective circuitry for receiving an IZTC. For example, the drain of transistor P802 is coupled to a first terminal of resistor R805 at which a VZTC (zero temperature coefficient voltage) is developed as a function of the values of the resistor R805 and the IZTC.

The various embodiments described above are provided by way of illustration only and should not be construed to limit the claims attached hereto. Those skilled in the art will readily recognize various modifications and changes that could be made without following the example embodiments and applications illustrated and described herein, and without departing from the true spirit and scope of the following claims.

What is claimed is:

1. A circuit, comprising:

a first amplifier for receiving a reference voltage proportional to absolute temperature (VPTAT) at an inverting input of the first amplifier and a reference base-to-emitter voltage (VBE) at a non-inverting input of the first amplifier, and for generating a first control signal in response to the reference VPTAT and the reference VBE;

a first transistor for generating a first reference zero temperature coefficient current (IZTC) in response to the first control signal, wherein the first transistor is coupled to a first common node, wherein the common node is operable to divide the first IZTC amongst a first branch, a second branch, and a third branch such that the first branch carries a first proportional to absolute temperature current (IPTAT) sourced from the common node, the second branch carries a second IPTAT sourced from the common node, and the third branch carries a first complementary to absolute temperature current (ICTAT) sourced from the common node, wherein the reference VPTAT is generated in response to the first IPTAT, and wherein the reference VBE is generated in response to the second IPTAT;

a second transistor comprising a source, a gate, and a drain, wherein the source of the second transistor is coupled to the third branch;

a third transistor comprising a source, a gate, and a drain, wherein:

the source of the third transistor is coupled to the third branch; and the gate of the third transistor is coupled to the drain of the third transistor;

a fourth transistor comprising a source, a gate, and a drain, wherein:

the source of the fourth transistor is coupled to the third branch;

the gate of the fourth transistor is coupled to the gate of the third transistor; and the drain of the fourth transistor is coupled to the gate of the second transistor; and a fifth transistor comprising a source, a gate, and a drain, wherein the source of the fifth transistor is coupled to the gate and drain of the third transistor;

a sixth transistor comprising a source, a gate, and a drain, wherein:

the source of the sixth transistor is coupled to the gate of the second transistor and the drain of the fourth transistor; and the gate of the sixth transistor is coupled to the drain of the second transistor;

a first resistor comprising a first terminal and a second terminal, wherein the first terminal of the first resistor is coupled to the drain of the second transistor and the gate of the sixth transistor; and a second resistor comprising a first terminal and a second terminal, wherein:

the first terminal of the second resistor is coupled to the drain of the fifth transistor and drain of the sixth transistor; and the second terminal of the second resistor is coupled to the second terminal of the first resistor;

and a seventh transistor for generating a second IZTC in response to the first control signal.

2. The circuit of claim 1 further comprising:

an eighth transistor for generating a third IZTC in response to the first control signal, the eighth transistor is coupled to a first terminal of a third resistor, wherein the third resistor is used to generate a zero temperature coefficient voltage (VZTC).

3. A system, comprising:

a power supply for generating an analog power source;

a first amplifier coupled to the power supply and operable to receive a reference voltage proportional to absolute temperature (VPTAT) at an inverting input of the first amplifier and a reference base-to-emitter voltage (VBE) at a non-inverting input of the first amplifier, the first amplifier being further operable to generate a first control signal in response to the reference VPTAT and the reference VBE; and a first transistor coupled to the analog power source and operable to generate a first reference zero temperature coefficient current (IZTC) in response to the first control signal, wherein the first transistor is coupled to a common node, wherein the common node is operable to divide the first IZTC amongst a first branch, a second branch, and a third branch such that the first branch carries a first proportional to absolute temperature current (IPTAT) sourced from the common node, the second branch carries a second IPTAT sourced from the common node, and the third branch carries a first complementary to absolute temperature current (ICTAT) sourced from the common node, wherein the reference VPTAT is generated in response to the first IPTAT, and wherein the reference VBE is generated in response to the second IPTAT;

a second transistor comprising a source, a gate, and a drain, wherein the source of the second transistor is coupled to the third branch;

a third transistor comprising a source, a gate, and a drain, wherein:

the source of the third transistor is coupled to the third branch; and the gate of the third transistor is coupled to the drain of the third transistor;

a fourth transistor comprising a source, a gate, and a drain, wherein:

the source of the fourth transistor is coupled to the third branch;

the gate of the fourth transistor is coupled to the gate of the third transistor; and the drain of the fourth transistor is coupled to the gate of the second transistor;

a fifth transistor comprising a source, a gate, and a drain, wherein the source of the fifth transistor is coupled to the gate and drain of the third transistor;

a sixth transistor comprising a source, a gate, and a drain, wherein:

the source of the sixth transistor is coupled to the gate of the second transistor and the drain of the fourth transistor;

the gate of the sixth transistor is coupled to the drain of the second transistor;

a first resistor comprising a first terminal and a second terminal, wherein the first terminal of the first resistor is coupled to the drain of the second transistor and the gate of the sixth transistor;

a second resistor comprising a first terminal and a second terminal, wherein:

the first terminal of the second resistor is coupled to the drain of the fifth transistor and drain of the sixth transistor; and the second terminal of the second resistor is coupled to the second terminal of the first resistor;

and a seventh transistor for generating a second IZTC in response to the first control signal.

4. The system of claim 3 further comprising:

an eighth transistor for generating a third IZTC in response to the first control signal, the eighth transistor is coupled to a first terminal of a third resistor, wherein the third resistor is used to generate a zero temperature coefficient voltage (VZTC).

* * * * *